United States Patent [19]

Saito et al.

[11] 4,105,719

[45] Aug. 8, 1978

[54] CARBURETOR WITH AUXILIARY ACCELERATOR-PUMP SYSTEM

[75] Inventors: Haruhiko Saito, Nagoya; Michio Morishita, Toyota, both of Japan

[73] Assignee: Toyota Jidosha Kogyo Kabushiki Kaisha, Toyota, Japan

[21] Appl. No.: 777,577

[22] Filed: Mar. 15, 1977

[30] Foreign Application Priority Data

Nov. 12, 1976 [JP] Japan ..... 51-135205

[51] Int. Cl.[2] ..... F02M 7/08

[52] U.S. Cl. ..... 261/34 B; 261/DIG. 74; 261/39 A

[58] Field of Search ..... 261/34 B, DIG. 74, 39 A

[56] References Cited

U.S. PATENT DOCUMENTS

| | | | |
|---|---|---|---|
| 1,544,350 | 6/1925 | Sisson | 261/34 B |
| 1,776,988 | 9/1930 | Tice | 261/34 B |
| 1,896,499 | 2/1933 | Tice | 261/34 B |
| 2,252,960 | 8/1941 | Brown | 261/41 D |
| 2,998,231 | 8/1961 | Marsee et al. | 261/34 B |
| 3,008,697 | 11/1961 | Dermond | 261/34 B |
| 3,576,315 | 4/1971 | Sutton | 261/39 D |
| 3,911,062 | 10/1975 | Johnson | 261/34 B |
| 3,933,951 | 1/1976 | Fischer et al. | 261/DIG. 74 |
| 4,018,856 | 4/1977 | Hamakawa et al. | 261/DIG. 74 |

*Primary Examiner*—Tim R. Miles

*Attorney, Agent, or Firm*—Stevens, Davis, Miller & Mosher

[57] ABSTRACT

A carburetor with an auxiliary accelerator-pump system including a diaphragm pump. The diaphragm pump includes a fuel chamber and a vacuum chamber which are separated by a spring-loaded diaphragm. The fuel chamber leads by way of a check valve to a fuel reservoir or float bowl in a carburetor and by way of another check valve to a pump jet or nozzle which is open into an intake passage in a carburetor, while the vacuum chamber leads to a vacuum take-off port open in the intake passage downstream of a throttle valve. The fuel chamber is further communicated by way of a temperature responsive valve means with the fuel reservoir, and this valve means is adapted to open, when an ambient temperature exceeds a given temperature level.

11 Claims, 2 Drawing Figures

CARBURETOR WITH AUXILIARY ACCELERATOR-PUMP SYSTEM

BACKGROUND OF THE INVENTION

1. Field of the Invention

This invention relates to a carburetor with an auxiliary accelerator-pump system, and more particularly to a carburetor having an accelerator-pump system which is equipped to cope with fuel leakage into the carburetor intake passage which is due to an ambient temperature rise.

2. Description of the Prior Art

It is known that operational characteristics of an internal combustion engine under cold weather are improved by providing a vacuum-operated auxiliary diaphragm pump in addition to a mechanical accelerator pump. Such pumps are adapted to supply additional fuel to an engine when accelerating or starting, for instance, in cooperation with the sudden opening of the throttle valve in a carburetor.

With prior art diaphragm pumps of this type, the interior of the pump is partitioned by a spring-loaded diaphragm into a vacuum chamber (a vacuum is introduced therein from an intake passage of the carburetor) and a fuel chamber. The vacuum chamber is communicated by way of a temperature responsive valve, which is adapted to be closed at tempertures above a given level, with a vacuum take-off port in an intake passage, while the fuel chamber is connected by way of a first check valve to a lower portion of a fuel reservoir or a float bowl and by way of a second check valve to a pump jet which opens into the intake passage of the carburetor.

When the ambient temperature is raised and hence fuel pressure in the auxiliary accelerator pump is increased, the fuel present in the fuel chamber or in the passage leading thereto tends to leak through the pump jet into the intake passage, thereby providing too rich a mixture charge and thus impairing the desired operation ability of the engine.

SUMMARY OF THE INVENTION

It is an object of the present invention to provide a carburetor with an auxiliary accelerator-pump system which will avoid the aforesaid shortcomings experienced with the prior art carburetors, i.e., leakage of fuel into the intake passage of the carburetor, when the ambient temperature exceeds a given temperature level.

It is a further object of the present invention to provide a carburetor with an auxiliary accelerator-pump system, which may bleed fuel into a fuel reservoir through a simple, temperature responsive valve means when the ambient temperature goes above a given temperature level, thereby avoiding leakage of fuel from the auxiliary accelerator pump into the intake passage of the carburetor.

According to the present invention, there is provided a carburetor with an auxiliary accelerator-pump system which comprises: an intake passage including a venturi portion and a throttle valve; a fuel reservoir; an auxiliary accelerator pump including a fuel chamber and a vacuum chamber which are separated by a spring-loaded diaphragm, the fuel chamber being communicated by way of a first check valve to a pump jet which opens into the intake passage upstream of a venturi portion and by way of a second check valve to a fuel reservoir or bowl, the fuel chamber being communicated by way of a temperature responsive valve means with a portion of the fuel reservoir above the fuel level therein, and the vacuum chamber being communicated with a portion of the intake passage downstream of the throttle valve.

RELATED APPLICATIONS

U.S. Application Ser. No. 782,347 filed Mar. 29, 1977 entitled Carburetor With Auxiliary Accelerator-Pump System, discloses another system having a vacuum operated valve.

DESCRIPTION OF THE PREFERRED EMBODIMENTS

Figure 1:
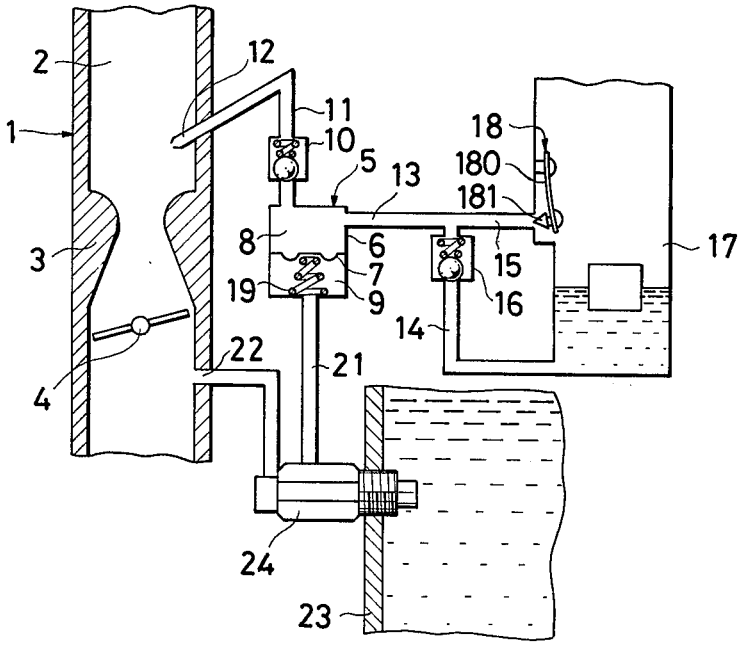
FIG. 1 is a schematic diagram of one embodiment of a carburetor with an auxiliary accelerator-pump system according to the present invention.
Figure 2:
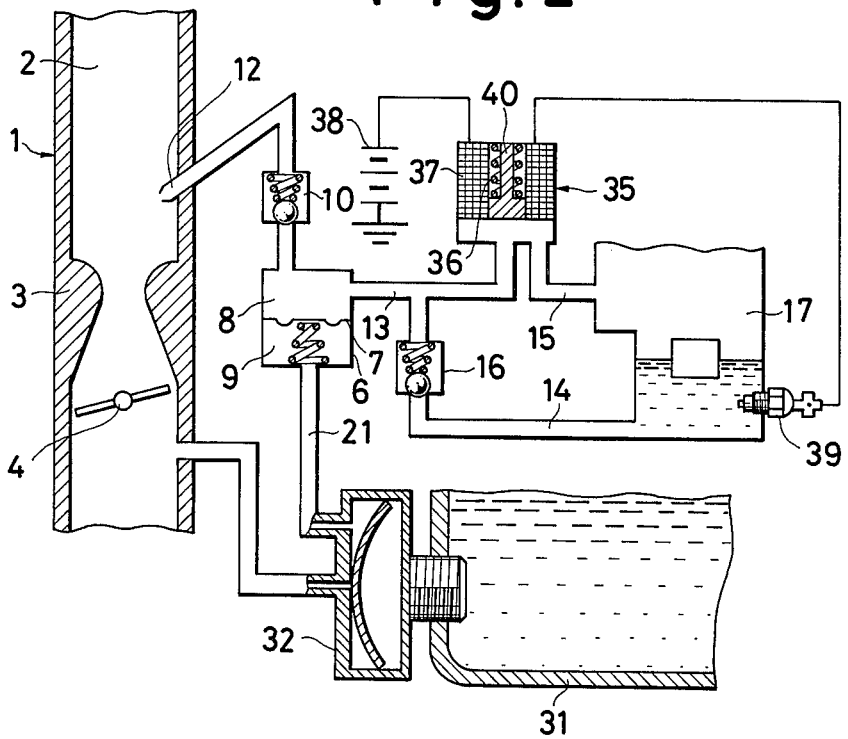
FIG. 2 is a schematic diagram of another embodiment of a carburetor with an auxiliary accelerator-pump system according to the present invention.

For simplicity of description, well known circuits for a carburetor, i.e., a float circuit, an idling-low speed circuit, a high speed circuit and an accelerator pump circuit cooperating with a throttle valve are omitted from FIGS. 1 and 2.

Referring to FIG. 1, the body 1 of a carburetor includes an air horn 2, a venturi 3 and a throttle valve 4 provided in the air horn 2 downstream of the venturi 3. A housing 6 of an auxiliary accelerator diaphragm pump 5 is partitioned by a vacuum-operated and spring-loaded diaphragm 7 into a fuel chamber 8 and a vacuum chamber 9. The fuel chamber 8 is communicated by way of a passage 11 including a check valve 10 to a pump jet 12 which is open into the air horn 2 upstream of the venturi 3. The aforesaid check valve 10 allows only a flow of fuel towards the pump jet 12. A passage 13 leading from the fuel chamber 8 is branched into two branch passages 14,15. The branch passage 14 has a check valve 16 adapted to allow only the flow of a fluid towards the intake passage and is connected to a lower portion of the fuel reservoir or float bowl 17, while the branch passage 15 opens into a portion of the float bowl 17 above the fuel level therein. The exit or opening of the passage 15 into the float bowl 17 is closed by means of a bimetal valve 18, when the ambient temperature remains below a given temperature level. The bimetal valve 18 consists of a bimetal piece 180, having one end secured to the inner wall of the float bowl 17 and a valve body 181 secured to the other end of the bimetal piece 180.

A coil spring 19 is disposed within the vacuum chamber 9. One end of the spring 19 is supported by the inner wall of the housing 6, while the other end of the spring 19 urges the diaphragm 7 towards the fuel chamber 8. The vacuum chamber 9 is communicated by way of a passage 21 with a vacuum take-off port 22 positioned downstream of the throttle valve 4 in the carburetor. In the embodiment of FIG. 1 positioned in the passage 21 is a heat sensitive valve 24 having a heat sensitive portion (with wax filled therein). This valve 24 is optional and the system is operative without it. The heat sensitive portion of the valve 24 is threaded into the cooling water jacket 23 of the engine. The heat sensitive valve 24 (for instance, a TVSV of Toyota manufacture) is so designed as to assume a closed position at temperatures above a given temperature level in the engine.

A description will now be given of the operation of the auxiliary accelerator-pump system according to the first embodiment of the present invention.

At the time of cold weather operation of an engine, the bimetal valve 18 is closed, while the temperature sensitive valve 24 is kept opened. When the engine is idling after starting, the throttle valve 4 is nearly closed. As a result, the vacuum created in the intake passage downstream of the throttle valve 4 is applied through the vacuum take-off port 22 by way of the passage 21 to the vacuum chamber 9. The vacuum causes the diaphragm 7 to deflect downwardly against the force of spring 19, thereby enlarging the fuel chamber 8. As a result, fuel from the float bowl 17 is introduced by suction by way of check valve 16 in the passage 14 into the fuel chamber 8.

When the throttle valve 4 is opened for acceleration, the vacuum prevailing from the vacuum take-off port 22 to the vacuum chamber 9 decreases to almost atmospheric pressure, so that the diaphragm 7 is returned to its initial position under the action of spring 19, and thus the fuel in the fuel chamber is delivered from the fuel chamber through the check valve 10 to the pump jet 12, and then injected into the air horn 2 of the carburetor, thereby supplying additional fuel to the engine for acceleration. When the engine is warmed up to a temperature above a given temperature level, the temperature sensitive valve 24 closes, thereby shutting off the communication of the vacuum chamber 9 with the vacuum take-off port 22.

As has been described earlier, when the ambient temperature is high, there arises a danger that fuel in the fuel chamber 8 of the pump 5 or in the passages 11 and 13 leading to the fuel chamber 8 would be expanded, so that the fuel would leak through the check valve 10 and pump jet 12 into the air horn 2 of the carburetor.

According to the present invention, there is provided a bimetal valve 18 which is so designed as to open at ambient temperatures above a given temperature level, so that the passage 15 is communicated with a portion of the fuel bowl 17 which is above the fuel level. Thus, fuel which is expanded or whose pressure is increased, will return by way of the passage 15 to the float bowl 17, thus eliminating the aforesaid danger of fuel leaking into the air horn 2.

FIG. 2 shows the second embodiment of the auxiliary accelerator-pump system according to the present invention. In this embodiment, a bimetal valve 32 (BVSV of Toyota manufacture) responds to the temperature of the oil pan 31, which temperature is dependent upon the operating condition of the associated internal combustion engine. Incorporated in the passage 15 is an electromagnetic valve 35 which is adapted to be opened at a temperature above a given temperature level. The electromagnetic valve 35 includes a solenoid 37, and a plunger 40, on which a spring 36 acts to urge it downwardly as shown in FIG. 2. The plunger 40 serves as a valve body as well. One end of the solenoid 37 is connected to a positive pole of a battery 38, whose negative pole is grounded, and the other end of the solenoid 37 is connected to a thermostatic switch 39, a temperature sensitive portion of the switch 39 being threaded into a wall of the float bowl 17. The thermostatic switch 39 is closed at temperatures below a given temperature level, and when it is closed the solenoid 37 is excited, thereby forcing the plunger 40 out against the action of the spring 36, and closing the passage 15.

On the other hand, the thermostatic switch 39 is opened at temperatures above a given temperature level, so that solenoid 37 is deenergized, thereby allowing spring 36 to return the plunger 40 to its initial position and to maintain the passage 15 in an open condition.

The operation of the auxiliary accelerator-pump system in this embodiment is similar to that of the embodiment shown in FIG. 1.

As is apparent from the foregoing description, a return passage from a fuel chamber in an auxiliary accelerator pump to a float bowl is opened, at ambient temperatures above a given temperature level, so that fuel stored in the fuel chamber is prevented from leaking into the air horn 2 of the carburetor and thus the operation of the engine will not be impaired by leakage of fuel.

Another important aspect is that it is possible to avoid the need for a temperature sensitive valve in the passage connecting the vacuum chamber of the auxiliary accelerator pump to the vacuum take-off port of the carburetor. This is because even if the auxiliary accelerator pump is operated at a temperature above a given temperature level, the return passage 13 from the fuel chamber to the float bowl is maintained open, so that fuel will return to the bowl and will not leak from the fuel chamber into the air horn 2 of the carburetor.

Although the present invention has been described with respect to specific details of certain embodiments thereof, it is not intended that such details be limitations upon the scope of the invention except insofar as set forth in the following claims.

What is claimed is:

1. A carburetor having a primary accelerator pump and a separate auxiliary accelerator-pump system adapted to be operated only at low ambient temperatures, said auxiliary accelerator-pump comprising:

an intake passage including a venturi portion and a throttle valve;

a fuel reservoir or bowl;

an auxiliary acceleration pump including a fuel chamber and a vacuum chamber which are separated by a spring-loaded diaphragm, said fuel chamber being communicated by way of a first check valve to a pump jet opening into said intake passage upstream of said venturi portion and by way of a second check valve to said fuel reservoir, said fuel chamber being further communicated with a portion of said fuel reservoir above the fuel level therein; and said vacuum chamber being communicated with a portion of said intake passage downstream of said throttle valve by way of a temperature sensitive valve between said vacuum chamber and said intake passage; and a temperature responsive valve means to open communication between said fuel chamber and the portion of said fuel reservoir above the fuel level therein, only when the ambient temperature exceeds a given level.

2. The system of claim 1 in which said first check valve allows only the flow of fluid towards said intake passage, and said second check valve allows only the flow of a fluid towards said fuel chamber.

3. The system of claim 1 in which said temperature responsive valve means is secured to the wall of said fuel reservoir.

4. The system of claim 1 in which said temperature sensitive valve is a wax-filled temperature sensitive type.

5. The system of claim 1 in which said temperature sensitive valve means is secured to a cooling water jacket of an internal combustion engine.

6. The system of claim 1 in which said temperature responsive valve means includes an electromagnetic valve for controlling the communication between said fuel chamber in said auxiliary accelerator pump and a portion of said fuel reservoir above the fuel level therein, and a temperature responsive switching means for exciting said electromagnetic valve.

7. The system of claim 6 in which said temperature responsive switching means is a thermostatic switch.

8. The system of claim 6 in which said temperature responsive switching means is secured to the wall of said fuel reservoir.

9. The system of claim 6 in which said electromagnetic valve includes a plunger and a solenoid having one lead connected to said temperature responsive switching means and the other lead connected to a battery.

10. The system of claim 6 in which said vacuum chamber in said auxiliary accelerator pump is communicated by way of a temperature responsive valve with said intake passage.

11. The system of claim 10 in which said temperature responsive valve is a temperature responsive disc type secured to an oil pan.

* * * * *